US009597583B2

(12) United States Patent
Loetz et al.

(10) Patent No.: US 9,597,583 B2
(45) **Date of Patent: *Mar. 21, 2017**

(54) LAUNCHABLE PROJECTILES AND LAUNCHERS FOR THE SAME

(71) Applicant: Imperial Toy LLC, North Hills, CA (US)

(72) Inventors: Lee Ronald Loetz, Oak Park, CA (US); Ami Nadav Shapiro, Granada Hills, CA (US); Leo Arzoomanian, North Hollywood, CA (US); Lawrence Temple Jones, Westlake Village, CA (US)

(73) Assignee: IMPERIAL TOY LLC, North Hills, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/704,806

(22) Filed: May 5, 2015

(65) Prior Publication Data

US 2015/0343301 A1 Dec. 3, 2015

Related U.S. Application Data

(63) Continuation of application No. 13/842,870, filed on Mar. 15, 2013, now Pat. No. 9,022,012.

(51) Int. Cl.
*F41B 3/02* (2006.01)
*A63F 9/02* (2006.01)
(Continued)

(52) U.S. Cl.
CPC ..... *A63F 9/0252* (2013.01); *A63F 9/0278* (2013.01); *A63H 33/18* (2013.01); *F41B 3/02* (2013.01); *F41B 7/02* (2013.01)

(58) Field of Classification Search
CPC ..... F41B 3/02; A63H 33/18
See application file for complete search history.

(56) References Cited

U.S. PATENT DOCUMENTS

| | | | |
|---|---|---|---|
| 1,626,892 | A | 5/1927 | Tidwell |
| 2,708,429 | A | 5/1952 | Tufts |

(Continued)

FOREIGN PATENT DOCUMENTS

| | | |
|---|---|---|
| CN | 201930546 | 8/2011 |
| GB | 2403667 | 1/2005 |
| WO | 2014151782 | 9/2014 |

OTHER PUBLICATIONS

PCT; International Search Report dated Jul. 7, 2014 in Application No. PCT/US2014/026441.

*Primary Examiner* — John Ricci
(74) *Attorney, Agent, or Firm* — Snell & Wilmer L.L.P.

(57) ABSTRACT

A projectile for launching through the air comprises a body and one or more projecting members integral therewith extending outwardly a distance from the body, which can be hollow or solid. The projectile is formed from an elastomeric material capable of being stretched to energize the projectile for launching. The projecting members are positioned a distance apart from one another and include openings disposed therethrough at distal ends for engaging sections of a launching device. The launching device includes a handle with the sections extending outwardly therefrom to accommodate placement of the projectile openings thereagainst for retaining the projectile before and during launch. The projectile is launched from the device by pulling the body away from the launching device to energize the projectile, and then releasing the energized projectile, causing it to be propelled from the launching device into the air and towards a desired target.

18 Claims, 17 Drawing Sheets

(51) Int. Cl.
*F41B 7/02* (2006.01)
*A63H 33/18* (2006.01)

(56) References Cited

U.S. PATENT DOCUMENTS

| | | | | |
|---|---|---|---|---|
| 4,749,286 | A | 6/1988 | White | |
| 4,991,841 | A * | 2/1991 | Paranto | A63B 43/00 446/490 |
| 5,279,276 | A | 1/1994 | Nagel et al. | |
| 5,579,749 | A | 12/1996 | Wilkinson | |
| 5,657,738 | A | 8/1997 | Klundt | |
| 5,938,499 | A * | 8/1999 | Chen | A63H 1/32 446/253 |
| 8,485,168 | B2 | 7/2013 | Walterscheid | |
| 8,864,136 | B2 * | 10/2014 | Pedersen | A63H 33/18 273/129 R |
| 9,022,012 | B2 | 5/2015 | Loetz et al. | |
| 2004/0198137 | A1 | 10/2004 | Ruiz | |
| 2013/0014735 | A1 | 1/2013 | Mowbray | |

* cited by examiner

LAUNCHABLE PROJECTILES AND LAUNCHERS FOR THE SAME

CROSS-REFERENCE TO RELATED APPLICATIONS

This patent application is a continuation of and claims priority to U.S. application Ser. No. 13/842,870, filed Mar. 15, 2013, now U.S. Pat. No. 9,022,012 issued May 5, 2015, which application is herein incorporated by reference in its entirety.

BACKGROUND

The success of a toy is measured by how effectively it is able to capture and engage a child's/user's imagination and/or engage the user in an activity that stimulates the user's senses. Some toys are additionally configured to stimulate a user's sense of coordination when using the toy. Projectile toys are known in the art, and examples of these are generally configured in the form of a gun that is designed to shoot foam projectiles.

While such projectile toys are useful for engaging the user and for helping to develop the user's sense of coordination and/or accuracy during play, the projectile itself when deployed does not operate to stimulate the user's visual and/or audible senses. Largely, the projectile is configured in the form of a foam cylinder that may or may not have a contact end that is configured to provide some type of effect when it comes into contact with an intended target, e.g., configured with an end that sticks and releasably attaches to the intended target. While this projectile feature is one the provides a user with some sense of feedback regarding the user's accuracy or coordination in trying to hit the intended target, it does nothing else in terms of visually and/or audibly stimulating the user during play.

It is, therefore, desired that launchable projectiles be configured in a manner that when launched operates to stimulates a number of the user's senses in addition to developing the user's sense of coordination and accuracy. It is further desired that launchers be developed in a manner that operates to facilitate launching of the projectiles in a manner calculated to assist the projectiles in displaying their engineered features.

SUMMARY

A projectile useful for being launching through the air comprises a body and one or more projecting members extending a distance from the body. The projecting members are formed from an elastomeric material that is capable of stretching a distance away from the body when placed into a pre-launch state and thereby energizing the projectile for launching. In an example, the body and the one or more projecting members are formed from the same material and are part of an integral one-piece construction. The body can have a solid or a hollow construction, and may have one or more surface features extending therefrom. The elastomeric material can be formulated to have a sticky or non-sticky outside surface.

The projecting members each have an opening disposed therethrough adjacent a distal end for engaging a launching device, wherein the opening can have a round or an elongate configuration. In an example, the projectile comprises a pair of projecting members each including openings therein for engaging a launching device, wherein the pair of projecting members extend from body at locations that are between about 45 to 180 degrees apart from one another. The projecting members can have a length that is greater than or equal to a diameter of the body.

A launch device useful for launching projectiles as disclosed herein includes a handle that can be held in the hand of a user, and includes means for accommodating placement of the projecting member opening thereagainst for holding and stretching the one or more projecting members relative to the launch device and energizing the projectile for launching. In an example, the means for accommodating comprises sections that extend from the handle that are spaced apart from one another a sufficient distance to enable the projectile once launched to pass therethrough. The projectile member is loaded into the launch device by placing the projectile member opening against respective launch device sections, retracting the projectile by grasping the body and pulling it away from the launch device to energize the projectile, and then releasing the projectile body when in an energized position to launch the projectile outwardly away from the launch device.

BRIEF DESCRIPTION OF THE DRAWINGS

These and other features and advantages of launchable projectiles and launchers as disclosed herein will be appreciated as the same becomes better understood by reference to the following detailed description when considered in connection with the accompanying drawings wherein.

DETAILED DESCRIPTION

Specific, non-limiting embodiments of launchable projectiles and launchers for use in conjunction with the same as disclosed herein will now be described with reference to the drawings. It should be understood that such embodiments are by way of example only and merely illustrative of but a small number of embodiments within the scope of the launchable projectiles and/or launchers as disclosed herein. Various changes and modifications obvious to one skilled in the art to which the launchable projectiles and/or launchers as disclosed herein pertains are deemed to be within the spirit, scope and contemplation of the invention as further defined in the appended claims.

Launchable projectiles as disclosed herein are also referred to interchangeably herein as projectiles or ammo, and are configured comprising a body and one or more projecting member extending outwardly from the body, wherein the projection member and the body are integral with one-another and formed of a one-piece construction. In an example, the projecting member includes an opening disposed therethrough that is configured to accommodate placement of a launching element therein for purposes of engaging and launching the projectile. In an example, the body and/or the projecting member may be configured differently depending on the desired visual, audible, and/or physical characteristics.

In an example, the projectile is formed from a shape-retaining elastomeric material that is capable deforming during a launching operation and/or upon impact with an object, and then returning to its original shape thereafter. A feature of such projectiles is that they are energized, i.e., the energy to launch the projectiles into the air is an inherent characteristic of the material that is used to form the projectile when it is activated by being stretched. A suitable material for forming projectiles as disclosed herein is rubber, and in a preferred embodiment is thermoplastic rubber (TPR). In an example, the projectiles are molded from TPR. The material used to form the projectile can be formulated to provide a sticky or nonsticky outside surface depending on the particular desired projectile use application. Where it is desired that the projectile, after being launched, stick or attach itself to a surface or target, then it is desired that the projectile be formed from a material having a sticky exterior surface.

Figure 1A:
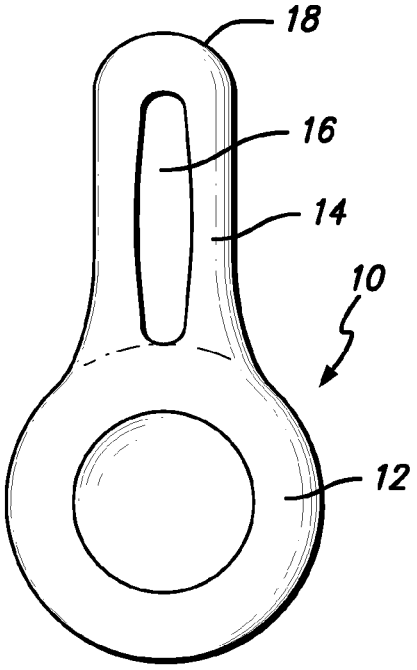
FIGS. 1A to 1D are perspective front views of example launchable projectiles as disclosed herein.
Figure 1B:
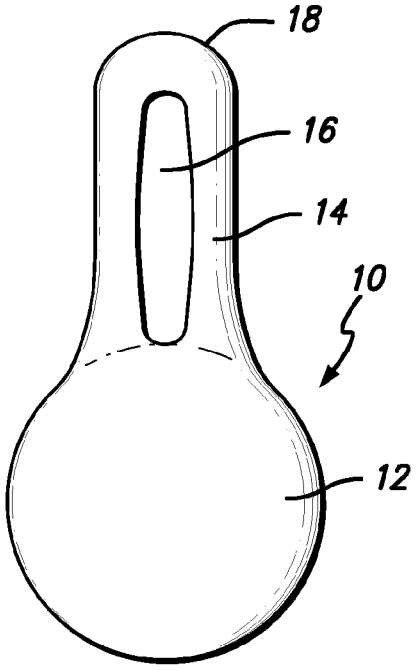

FIGS. 1A to 1D illustrate example projectiles 10 as disclosed herein that each comprise a body 12 and a single integral projecting member 14 extending outwardly therefrom. FIGS. 1A and 1B illustrate projectiles 10 each comprising an elongate opening 16 extending along the length of the projecting member 14, wherein the body 12 of the projectile of FIG. 1A is configured having a flat or even a concave shape, and wherein the body 12 of the projectile of FIG. 1B is configured having a rounded or convex shape. The shape of the body affects how the projectile travels through the air when launched. A body with a flat body gives the projectile a gliding flight, while the rounded body shape adds weight to the projectile which can influence the landing impact of the projectile and/or may influence the distance of flight travel.

Figure 1C:
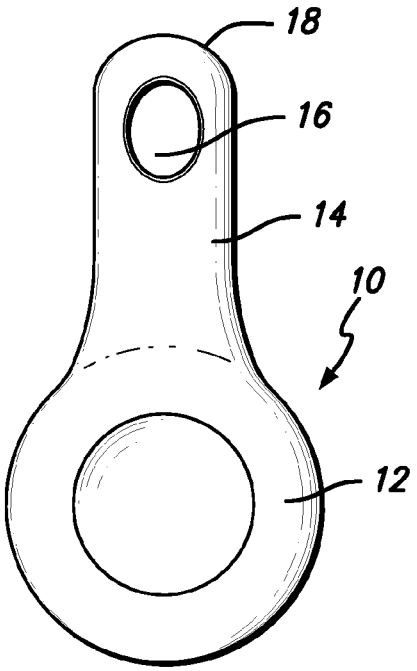
Figure 1D:
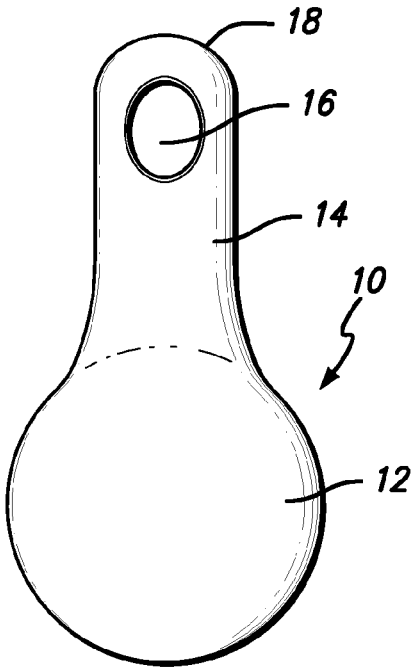

FIGS. 1C and 1D illustrate projectiles 10 each comprising an round or only slightly elongate opening 16 (when contrasted with the opening in the projectiles illustrated in FIGS. 1A and 1B) that are positioned near a distal end 18 of the projecting member 14, wherein the body 12 of the projectile of FIG. 1C is configured the same as that illustrated in FIG. 1A, and wherein the body 12 of the projectile of FIG. 1D is configured the same as that in FIG. 1B. The configuration of the opening in the projectile influences the extent to which the projectile can be stretched for launching, wherein an elongate opening allows the projectile to be stretched further than a round or only slightly elongate opening. Projectiles configured having an elongate opening stretch further during launching, and as a result provide a longer flight distance than projectiles having a round or only slightly elongate opening.

Figure 2A:
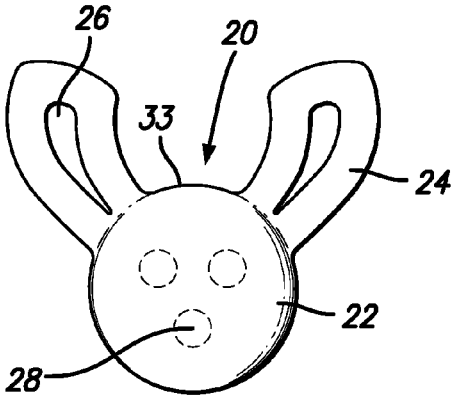
FIGS. 2A to 2T are perspective front views of example launchable projectiles as disclosed herein.
Figure 2B:
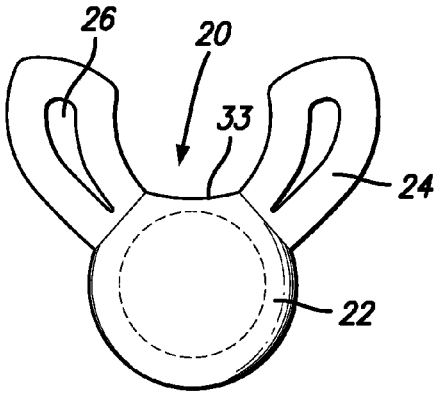

FIGS. 2A to 2U illustrate different example projectiles as disclosed herein that are each configured comprising a body and a pair of projecting members projecting therefrom. The projecting members are positioned along the body so that they project from a similar hemispheric section of the body. In an example, the projecting members are about 60 to 110 degrees apart from one another. The projectiles are configured in this manner to enable them to be launched from a device (having dual appendage hooks or arms that are aligned parallel to one another), and do so in a manner that does not damage the projectile when stretched or energized during a launch operation.

Projectiles as disclosed herein and illustrated in FIGS. 2A to 2U can be configured having a hollow, solid, or semi-solid bodies, having projecting members that extend outwardly in a curved or straight manner, having projecting members with elongate or round openings, having feet or other features extending from the body, and the like depending on the desired projectile performance characteristics. The projectiles can be colored or uncolored, can be made having a sticky or nonsticky surface, or having a body comprising a particular design or shape. FIGS. 2A to 2E each illustrates a projectile 20 comprising a spherical or ball-shaped body 22 having projecting members 24 that extend outwardly from the body in a curved manner towards one another and that each have elongate openings 26 disposed therethrough. The projectile of FIG. 2A comprises a body 22 that includes one or more light elements 28, e.g., in the form or an LED or the like, disposed therein to light up before, during and/or after being launched, and the projectile is uncolored. The projectiles of FIGS. 2B and 2D each comprise a hollow body 22 and are uncolored and colored, respectively. The projectiles of FIGS. 2C and 2E comprise a semi-solid and solid body 22, respectively. Specifically, the projectile of FIG. 2C comprises a solid body 22 having a number of open passages 30 extending therethrough. In an example, the passages 30 are oriented within the body 22 parallel to one another, and are positioned relative to the projecting members so as to enable air to pass through the passages when the projectile is launched and traveling through the air. The number and size of the passages can and will vary. In an example, the projectile comprises 4 passages and the passages are configured to provide an audible sound, e.g., whistle or the like, and/or to assist projectile glide, when launched during flight. Specifically, the projectile of FIG. 2E comprises a solid body 22 having one or more features 32 extending therefrom. In an example, the body 22 comprises features in the form of a pair of fins or feet 32 extending from a hemispheric section of the body opposite the projecting members.

In an example, the body 22 of the projectiles illustrated in FIGS. 2A to 2E may also comprise a concave or inwardly dished section 33 interposed between the projecting members 24. The shape of the body inwardly dished section 32 can follow the curvature of the two projecting members 24. In an example, the inwardly dished section 32 can function to facilitate attachment of the projectile when it is launched and make contact with a surface, e.g., when the projectile comprises a hollow body and/or is formed from a material providing a sticky outer surface.

FIGS. 2F to 2I illustrate example projectiles 34 that are different from those discussed above and illustrated in FIGS. 2A to 2E, in that such projectiles 34 comprise a body 36 that is flat having a generally circular outer circumference, and that is not spherical or ball-shaped, and that comprises projecting members 38 that extend outwardly from the body in a curved manner towards one another. Projectiles configured in this manner, i.e., having a flat body, operate to provide the projectile with a gliding flight when launched as contrasted with projectiles having a spherical or ball-shaped body. The flat body can be configured having opposed dished surfaces or other surface features that may be useful for holding the projectile during launching. Additionally, the body can be configured having different decorative designs, insignia, shapes, logos, or the like as desired.

Figure 2C:
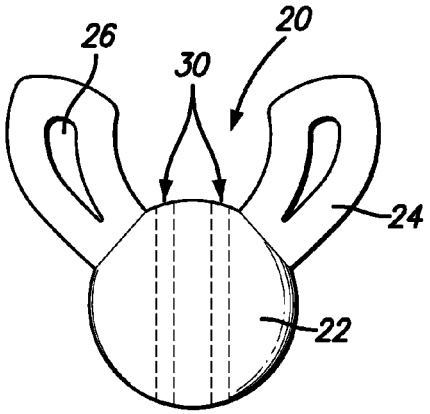
Figure 2D:
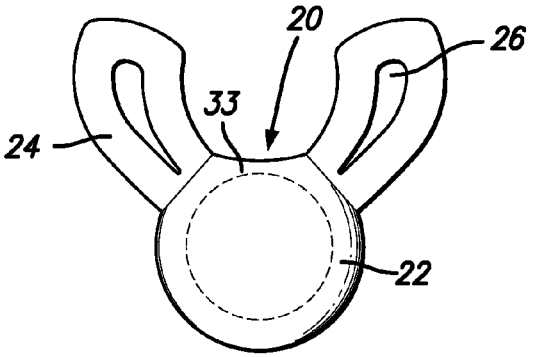
Figure 2E:
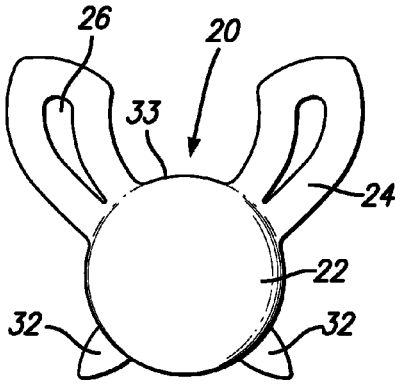
Figure 2F:
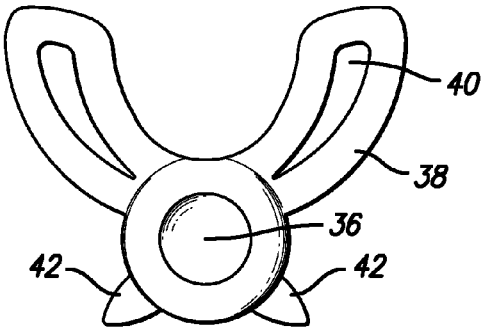

FIG. 2F illustrates a projectile 34 comprising projecting members 38 each having elongate openings 40, and further comprising surface features 42 extending from the flat body opposite the projecting members. In an example, the surface features are provided in the form of fins or feet 42 projecting outwardly a distance from the body and are positioned approximately 90 degree apart from one another. The projectile illustrated in FIG. 2F is formed from a transparent material and is further formed having s sticky external surface to promote sticking to a target or surface. Alternatively, this example may be formed from a colored material that may or may provide an external sticky surface.

Figure 2G:
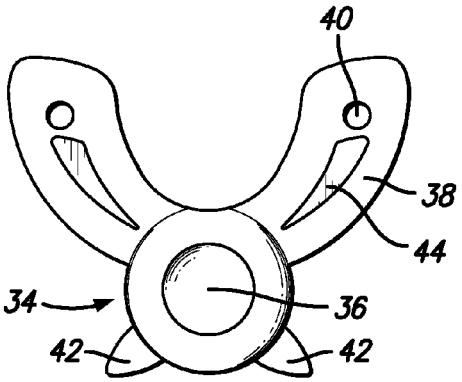
Figure 2H:
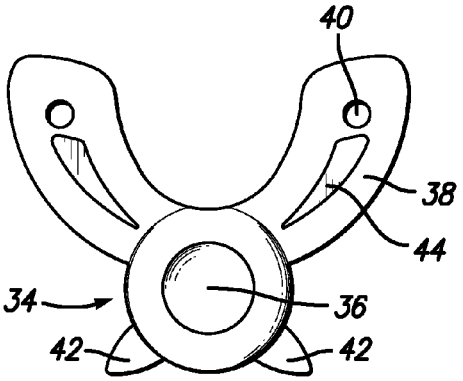

FIGS. 2G and 2H illustrate projectiles 34 that are somewhat similar to that illustrated in FIG. 2F, comprising a flat body 36 and a pair of curved projecting members 38, except that the openings 40 within the projecting members are round and not elongate. The openings 40 are located at the distal ends of the projecting members 38, and the remaining portion of the projecting members extending to the body comprises a web of material 44 thereby operating to limit the extent of the openings to the distal end of each projecting member. These examples also include the surface features, fins or feet 42. The web of material 44 disposed within the projecting members of these projectile operates to reduce the elasticity of the projecting arms during launch, and thereby reduces the flight distance of the projectiles when compared to that illustrated in FIG. 2F.

Figure 2I:
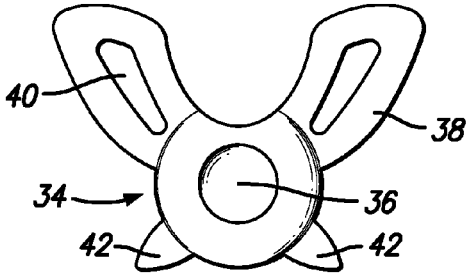

FIG. 2I illustrates an example projectile 34 that is somewhat similar to that illustrated in FIG. 2F, comprising a flat body 36 and a pair of curved projecting members 38 having elongate openings 40, and having surface features, fins or feet 42, except that the projecting members 38 are shorter in length than those illustrated in FIG. 2F. In the projectile embodiments described above and illustrated in FIGS. 1A to 2H, the projecting members have had a length roughly equal to or greater than the diameter of the respective body. The length of the projecting members in the example of FIG. 2I is shortened to provide shorter pull back during launch and shorter flight distance when compared to similarly configured projectiles having longer projecting members 38.

FIGS. 2J to 2O illustrate different example projectiles 50, generally comprising a body 52 with projecting members 54 that extend straight outwardly in an uncurved manner away from the body. In an example, the projecting members 54 are positioned approximately 90 degrees apart from one another along the body. These projectiles 50 are made from a TPR material that is relatively more stretchable than the material used to form the earlier-described projectiles to provide a greater degree of elasticity during launch.

Figure 2J:
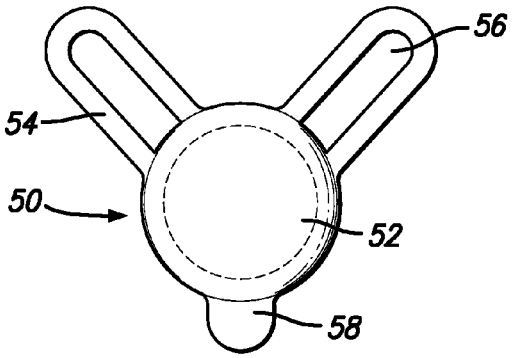
Figure 2K:
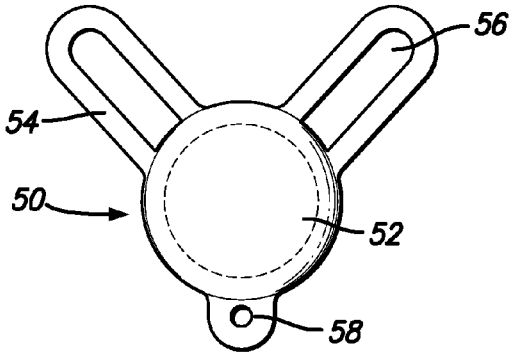
Figure 2L:
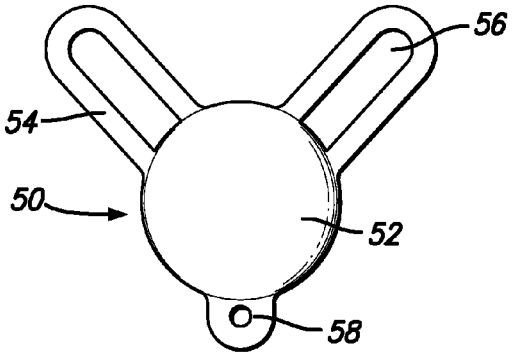

FIGS. 2J to 2L illustrates projectiles 50 comprising a spherical or ball-shaped body 52 comprising a pair of projecting members 54 extending straight outwardly therefrom, and each having an elongate opening 56 extending from a distal end of the projecting member to the body. The projectiles of FIGS. 2J and 2K comprise a hollow body, while the projectile of FIG. 2L comprises a solid body. The projecting members 54 extend a length from the body that is equal to or greater than the diameter of the body, and may have a thickness that is different depending on the particular launch characteristic desired. The body also includes a surface feature, fin, foot or tab 58 extending outwardly a distance therefrom and that is positioned opposed from the projecting members 54.

Figure 2M:
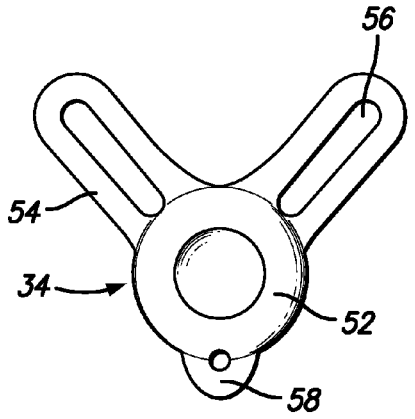
Figure 2N:
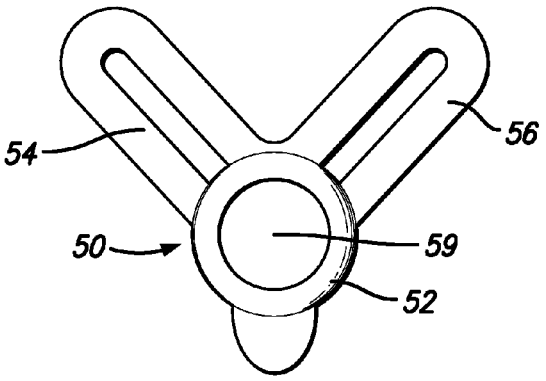
Figure 20:
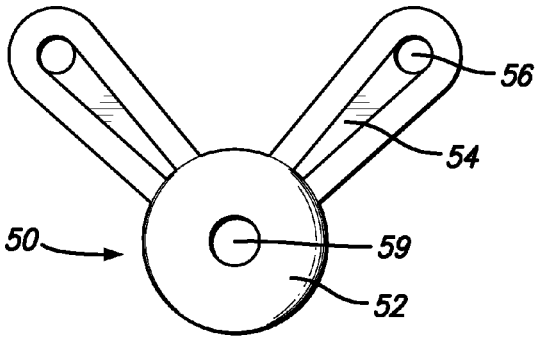

FIG. 2M illustrates a projectile 50 that is generally similar to that disclosed above for the projectile of FIG. 2L, except that it comprises a flat body 52. FIG. 2N illustrates a projectile 50 that is generally similar to that disclosed above for the projectile of FIG. 2M except that the flat body 52 comprises a large hole or opening 59 extending therethrough, FIG. 2O illustrates a projectile 50 that is generally similar to that disclosed above for the projectile of FIG. 2N, except that the opening 59 through the flat body is smaller and the projecting members each comprise an opening 56 that is round and not elongate. The opening 56 in each projecting member is positioned adjacent an distal end, and a web of material used to form the projectile extends therefrom in each projecting member to the body. As noted above, configuring the projecting members and openings in this manner reduces the stretch or pull back of the projectile during launch, thereby limiting projectile flight distance.

For the projectiles described above and illustrated in FIGS. 1A to 20, the bodies are sized having a diameter of about 1 inch, and projecting members that vary in length from about 1 to 1½ inches. It is to be understood that projectiles can be sized differently and be within the scope of projectiles disclosed herein.

Figure 2P:
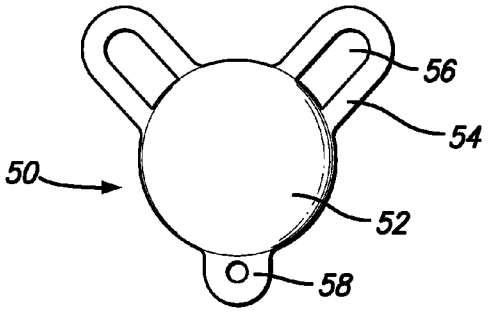
Figure 2Q:
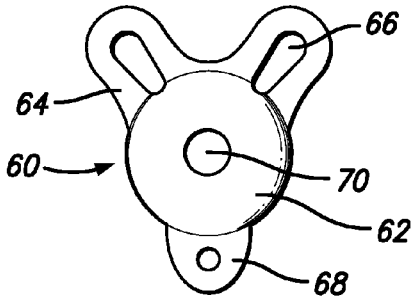

FIGS. 2P to 2S illustrate example projectiles 60 that are generally configured comprising a body 62 that can be spherical or ball-shaped and hollow or solid or that can be flat, with projecting members 64 extending therefrom, wherein the projecting members are relatively shorter than those described above. In an example, the projecting members 64 of the projectiles illustrated in FIGS. 2P to 2S are sized shorter than the diameter of the respective body. Such projectiles having short-sized projecting members are useful for making projectiles where shorter pull back for launch and shorter flights are desired, when compared to the projectiles described above having longer projecting arms. Specifically, FIG. 2P illustrates a projectile 60 comprising a semi-spherical body 62 that is rounded on top and flat on the bottom, with projecting members 64 extending a short distance outwardly and having elongate openings 66, and comprising a surface feature, fin, tab or foot 68 extending outwardly from the body at a location opposed to the projecting members. FIG. 2Q illustrates a projectile 60 comprising a flat body 62 having a hole 70 disposed therethrough, with projecting members 64 extending a short distance outwardly and having elongate openings 66, and comprising a surface feature, fin, tab or foot 68 extending outwardly from the body at a location opposed to the projecting members.

Figure 2R:
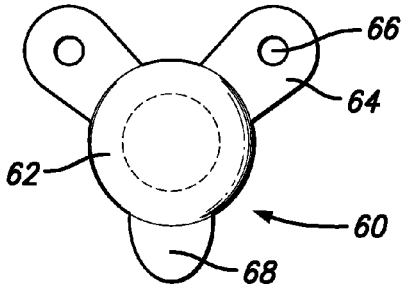
Figure 2S:
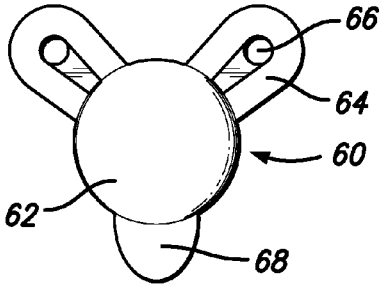

FIG. 2R illustrates a projectile 60 comprising a hollow spherical or rounded-ball shaped body 62, with projecting members 64 extending a short distance outwardly and having circular openings 66, and comprising a surface feature, fin, tab or foot 68 extending outwardly from the body at a location opposed to the projecting members. The circular openings are positioned at the distal ends of the projecting members, and a web of material extends therefrom along the projecting members to the body. FIG. 2S illustrates a projectile 60 comprising a solid spherical or rounded-ball shaped body 62, with projecting members 64 extending a short distance outwardly and having circular openings 66, and comprising a surface feature, fin, tab or foot 68 extending outwardly from the body at a location opposed to the projecting members. The circular openings in these projectile embodiments serve to further limit or control the pull back and provide shorter travel when launched.

Example projectiles as described above and illustrated make use of a variety of differently configured bodies such as spherical, which can be hollow or solid, which can be flat and rounded and be configured to have a hole or some other type of surface feature, it is to be understood that projectiles as disclosed herein can be configured having combinations of all of these different body shapes, e.g., having one side flat and another side rounded, having a combination of solid and hollow portions, and the like. Further, projectiles as described above and as illustrated may include additional surface features extending therefrom at locations generally opposed from the projecting members, wherein such surface features are configured to provide a desired characteristic to the projectile. Examples of such surface features include one or more fins, tabs or feet. It is to be understood that projectiles as disclosed herein may comprise any combinations of these features and/or other or different surface features extending therefrom, which surface features may operate to enhance projectile characteristics involved in launch, flight, and/or contact with an intended target or surface.

Figure 2T:
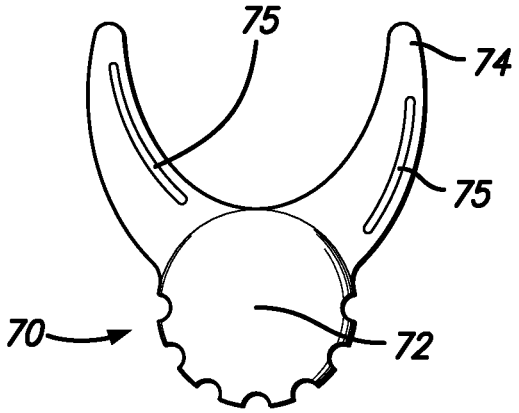

The projectiles as disclosed herein have been disclosed and illustrated as comprising one or a pair of projecting members extending from the body. In examples where two projecting members are used, they have been disclosed and illustrated as comprising openings that are elongate or round, and these openings are oriented having two separate and distinct axis that are in parallel alignment with one another, i.e., an axis extending through one opening is separate from and extends in parallel with an axis extending through the other opening. It is to be understood that projectiles may be configured differently. For example, FIG. 2T illustrates a projectile 70 comprising a body 72 having a pair of projecting members 74 extending therefrom. In this example, the projecting members 74 each include an opening 75 (which may be round or elongate), and wherein the openings are oriented relative to one another having a common axis extending therethrough. In other words, in this example projectile embodiment the projectile member openings face sideways where for all the other example projectile embodiments the projectile member openings face upwards.

The projecting members and the relative size and shape of the projecting members and their respective openings operate influence the stretchability of the projectile during launch, and thereby influences the travel distance of the projectile. It is generally desired that the ends of the openings be rounded so as to prevent tearing during a launch operation. It is generally desired that the thickness of the projectile members be such as to provide the desired stretchability during launch to provide a desired flight distance without damaging the projectile. The configuration of the body also influences the characteristics of the projectile, e.g., a solid body tends to travel further than a hollow body, a hollow body filled with air tends to be more flexible so that it can stick to impacted surfaces, a round body weighs more than a flat body which can influence the travel distance, surface features and/or openings through the body can operate to influence flight distance and/or accuracy.

Projectiles as disclosed herein can be formed from the materials disclosed above. Additionally, the projectiles can be formed having a one or more color, being transparent, being translucent, being fluorescent, being illuminescent, phosphorescent, and the like. Further, projectiles as disclosed herein can be configured having different finishes, e.g., can be smooth, rough, stick, nonsticky. Further, projectiles as disclosed herein can be configured having a composite construction, e.g., wherein the body includes one or more element disposed therein, which element can provide some desired launch, flight and/or impact characteristic. An example of this is the projectile comprising one or more light elements disposed therein.

Figure 3A:
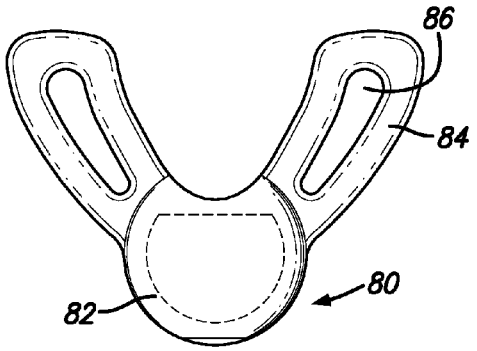
FIGS. 3A to 3D are perspective front views of example launchable projectiles as disclosed herein.
Figure 3B:
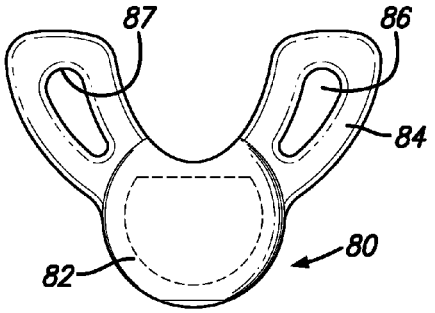

FIGS. 3A to 3D illustrate larger views of example projectiles 80. Specifically, FIG. 3A illustrates a projectile similar to that illustrated in FIG. 2B comprising a hollow spherical or round-shaped body 82 with a pair of curved projecting members 84 extending outwardly, wherein the projecting members each comprise an elongate opening 86. FIG. 3B illustrates an example projectile similar to that illustrated in FIG. 2D comprising a hollow spherical or round-shaped body 82 with a pair of curved projecting members 84 extending outwardly, wherein the projecting members each comprise an elongate opening 86. The projecting members for the projectile of FIG. 3A are longer than those of the projectile of FIG. 3B. FIG. 3B helps illustrate the rounded ends 87 of the elongate opening for the purpose of reducing possible tearing of the projecting members during a launching operation.

Figure 3C:
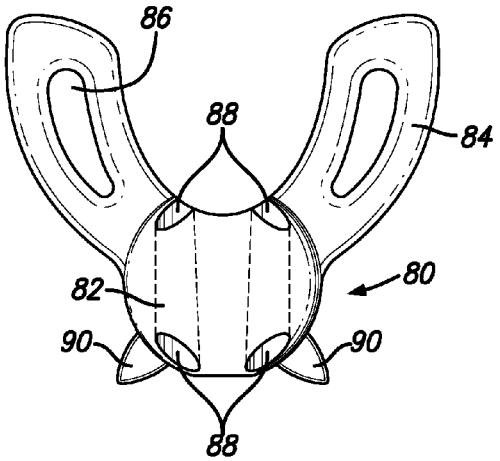
Figure 3D:
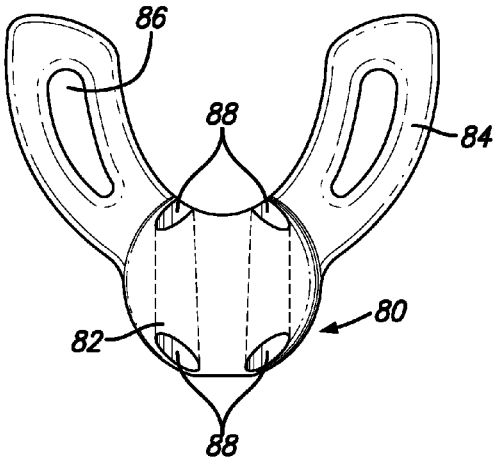

FIGS. 3C and 3D illustrates projectiles somewhat similar to that illustrated in FIG. 2C comprising a semi-solid spherical or round-shaped body 82 comprising a number of perforations or openings 88 extending through the body, and having a pair of curved projecting members 84 extending outwardly, wherein the projecting members each comprise an elongate opening 86. In an example, the body comprises four perforations extending diametrically through body, wherein the perforations are parallel to one another and oriented each having an axis in parallel and in line with the direction of flight when launched so that air passes from a front section of the body adjacent the projecting members to an opposed back section via the passages 88. The projectile of FIG. 3C additionally includes surface features 90 in the form of a pair of fins or feet extending outwardly a distance from the body.

Figure 4A:
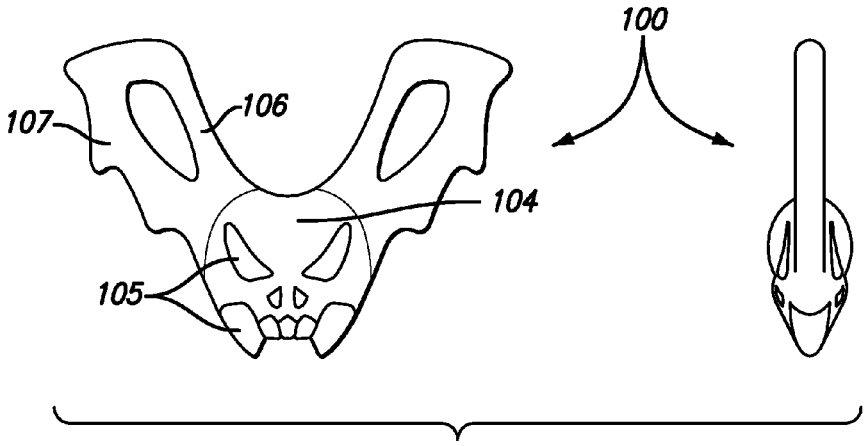
FIGS. 4A to 4C are perspective front and side views of example launchable projectiles as disclosed herein.
Figure 4B:
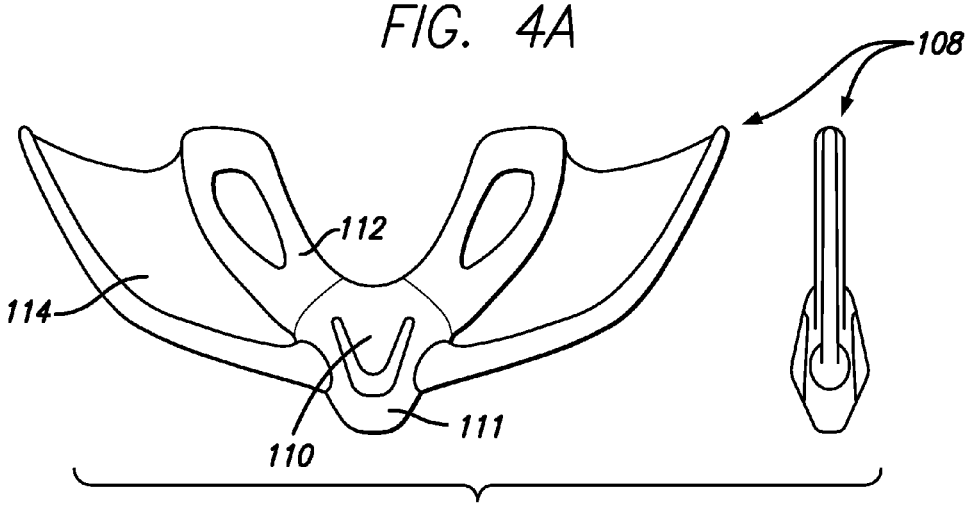
Figure 4C:
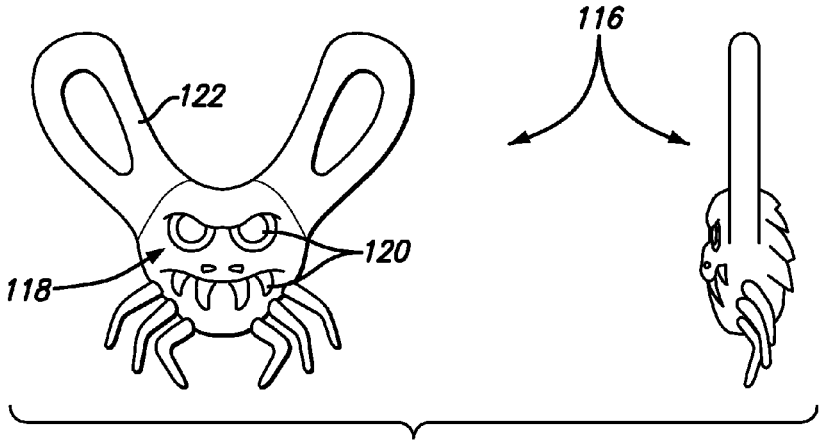

FIGS. 4A to 4C illustrate further example projectiles configured to take on the shape of particular object, such as a bird, insect, bat or the like. Such desired shape can be accomplished by adding further surface features to the projectile body and/or projecting members. FIG. 4A illustrates a projectile 100 configured in the form of a bat, wherein the body 104 is configured having surface features 105 replicating eyes and teeth, and wherein the projecting members 106 are configured having surface features 107 replicating wing elements. FIG. 4B illustrates a projectile 108 configured in the form of a winged flyer, wherein the body 110 is configured having one or more surface features 111 facilitating aerodynamic gliding travel, and wherein the projecting members 112 are configured having surface features 114 extending outwardly therefrom replicating wings. FIG. 4C illustrates a projectile 116 configured in the form of an insect or bug, wherein the body 118 is configured having one or more surface features 120 replicating eyes, teeth and legs of an insect or bug, and wherein the projecting members 122 are configured without additional surface features. These are but a few examples provided for reference of how projectiles as disclosed herein can be configured differently to replicate a particular object, and it is to be understood that all such variations of projectiles are within the scope as disclosed herein.

Figure 5A:
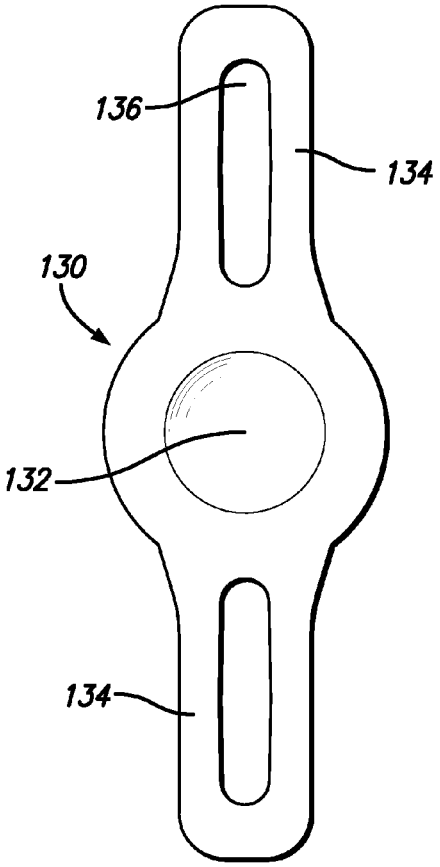
FIGS. 5A to 5B are perspective front views of example launchable projectiles as disclosed herein.
Figure 5B:
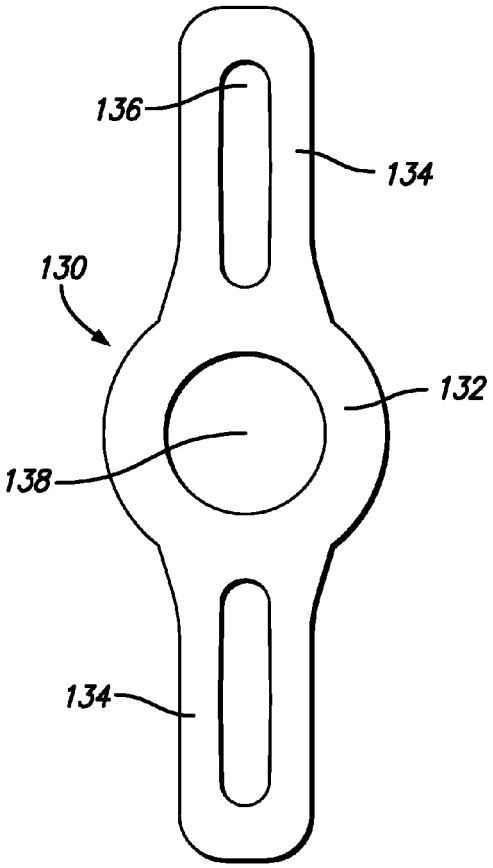

FIGS. 5A and 5B illustrate example projectiles 130 configured differently from those described above. Specifically, such projectiles 130 each comprises a body 132 that is centrally positioned between diametrically opposed projecting members 134. FIG. 5A illustrates a projectile 130 comprising a flat body and having a pair of projecting members 134 extending therefrom at diametrically opposed positions, and having elongate openings 136. FIG. 5B illustrates a projectile 130 that is somewhat similar to that illustrated in FIG. 5A except that the body comprises a hole 138 disposed therethrough. Such example projectiles are useful for referencing how the projecting members can be positioned differently relative to the body.

While projecting members have been disclosed as comprising 1 or 2 projecting members extending the body, it is to be understood that projectiles as disclosed herein may comprise more than 2 projecting members depending on the particular launch, flight, and/or impact characteristic desired and that alternative embodiments are within the scope of projectiles as disclosed herein.

Projectiles as disclose herein can be launched using a number of differently configured launchers or launch devices. Generally, such launch devices comprise an element for engaging the opening in the one or more projecting members of the projectiles, and for permitting the projectile to be energized for launch by being stretched a away from the element. The element can be provided in the form of a user's finger or fingers, or in the form of a separate launching device.

Figure 6A:
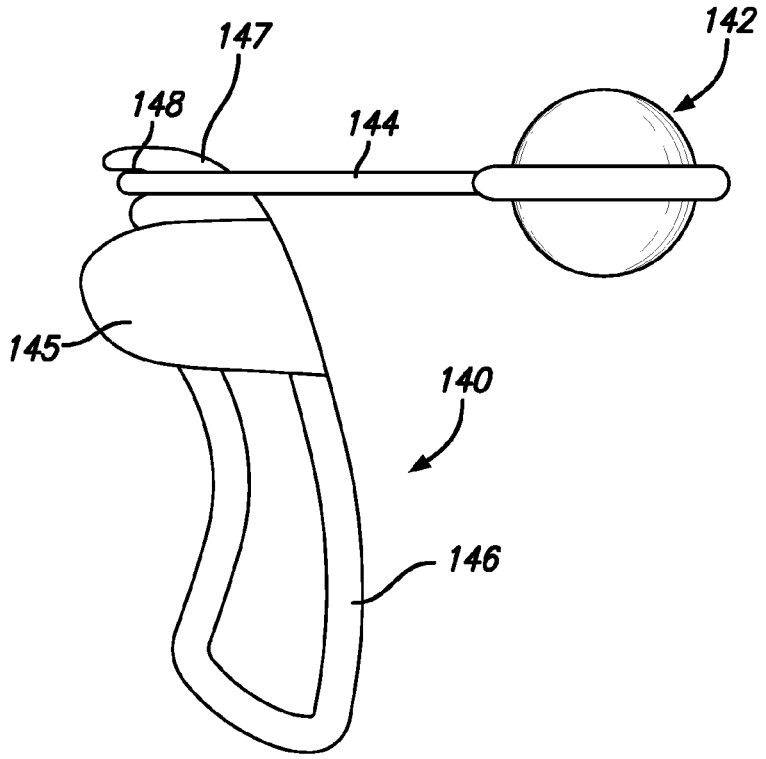
FIGS. 6A and 6B are respective side and front views of an example launcher as disclosed herein.
Figure 6B:
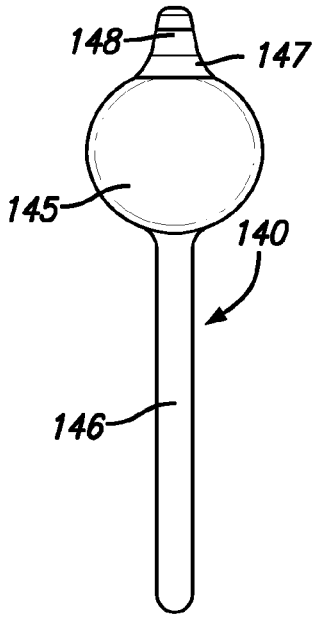

FIGS. 6A and 6B illustrate side and front views, respectively of an example launch device or launcher 140 configured to accommodate launching of a projectile 142 having a single projecting member 144 (as illustrated in FIGS. 1A to 1D). Specifically, the launcher 140 comprises conical member 145 that is configured to fit over a portion of a user's thumb, and a handle 146 that extends downwardly from the conical member and that is configured to be gripped in the user's hand between their finger(s) and palm. The conical member includes an arm 147 projecting upwardly therefrom that includes a recessed section 148 for accommodating placement of the projectile projecting member opening therein. The projectile is energized and launched by the user holding the launcher 140, placing the projectile projecting member opening within the arm recessed section 148 and then pulling the projectile away from the launcher, thereby stretching the projecting member and energizing the projectile for launch. The projectile is launched and released from the launcher by the user releasing the projectile body.

Figure 7:
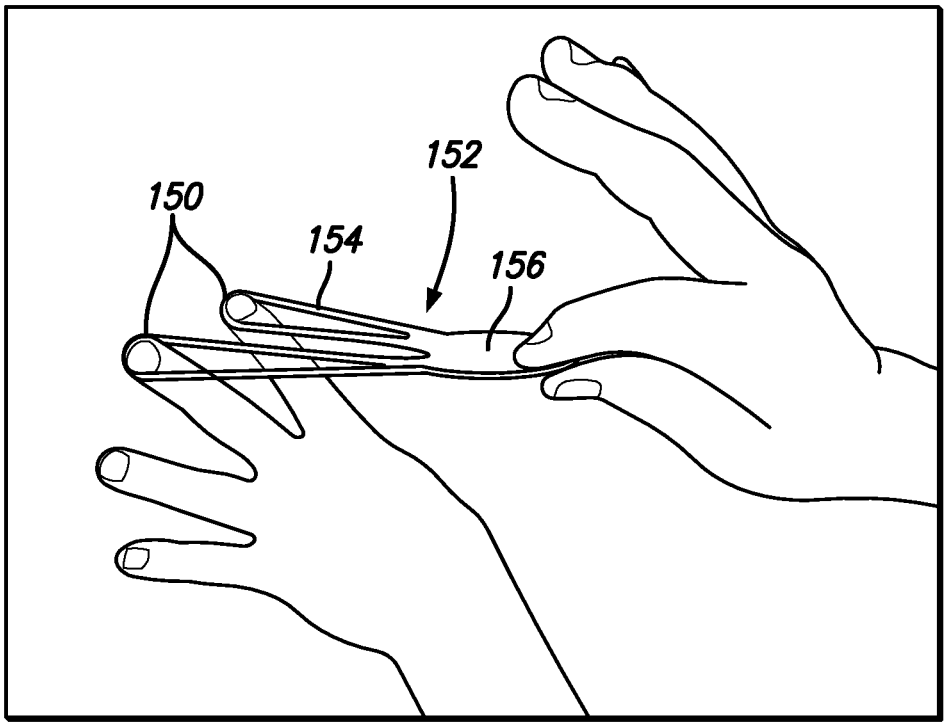
FIG. 7 is a perspective view of an example launcher as disclosed herein in the form of a user's fingers.

In some cases the launch device can be a user's finger or fingers, wherein the opening of the projectile's one or more projecting members is positioned over a respective finger and the projectile is energized by being pulled back therefrom. FIG. 7 illustrates how a user's fingers 150 of one hand can be used to engage the projectile 152 projecting members 154, and how the projectile body 156 can be pulled back using fingers of the other hand to stretch and energize the projectile for launching. While a launcher in the form of a user's fingers has been illustrated in the context of launching a projectile having a pair of projecting member, it is to be understood that projectiles comprising a single projecting member can also be launched in this manner, i.e., via a user's single finger.

Figure 8A:
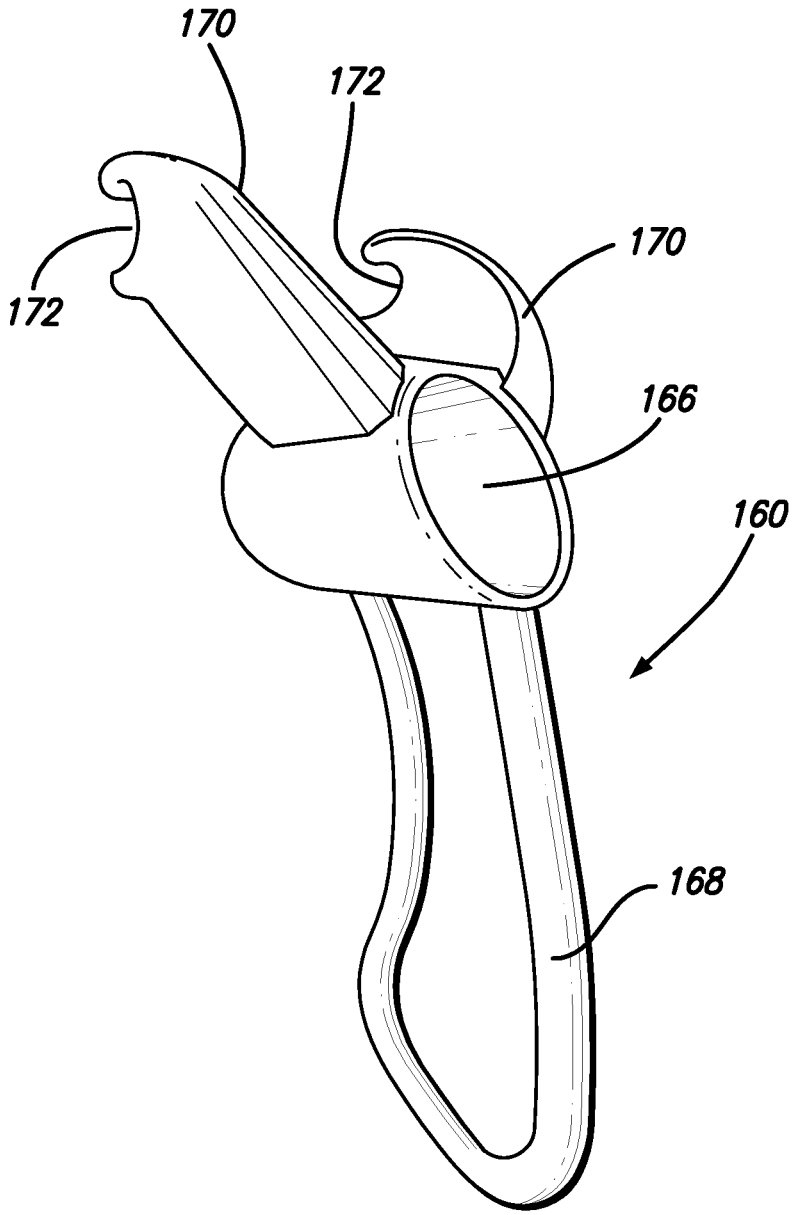
FIGS. 8A and 8B are perspective views of an example launcher and a launcher loaded with a launchable projectile, respectively, as disclosed herein.
Figure 8B:
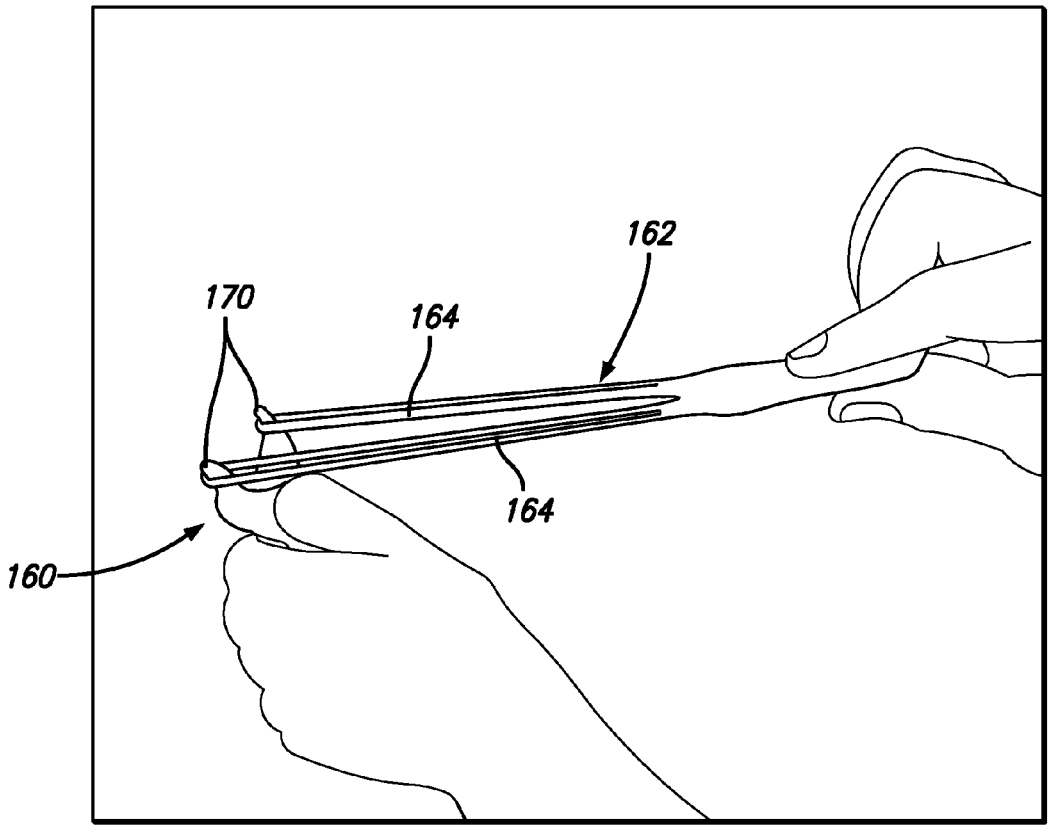

FIGS. 8A and 8B illustrate a launcher 160 with and without a projectile. Referring to FIG. 8A, the launcher is generally configured to facilitate launching a projectile 162 comprising a pair of projecting members 164. Specifically, the launcher 160 is configured somewhat similar to that illustrated in FIGS. 6A and 6B, comprising a conical member 166 configured to fit over a portion of a user's thumb, and a handle 168 extending downwardly from the conical member and that is configured to be gripped in the user's hand between their finger(s) and palm. The difference is that the conical member of this launcher includes a pair of arms 170 projecting upwardly therefrom that each includes a recessed section 172 for accommodating placement of a respective projectile projecting member opening therein. The arms are spaced apart a sufficient distance, and extend outwardly a sufficient length, to enable the projectile once launched to pass therebetween. As illustrated in FIG. 8B, the projectile is energized and launched by the user holding the launcher 160, placing the projectile projecting member openings within respective arm 170 recessed sections and then pulling the projectile 162 away from the launcher, thereby stretching the projecting members and energizing the projectile for launch. The projectile is launched and released from the launcher by the user releasing the projectile body.

Figure 9A:
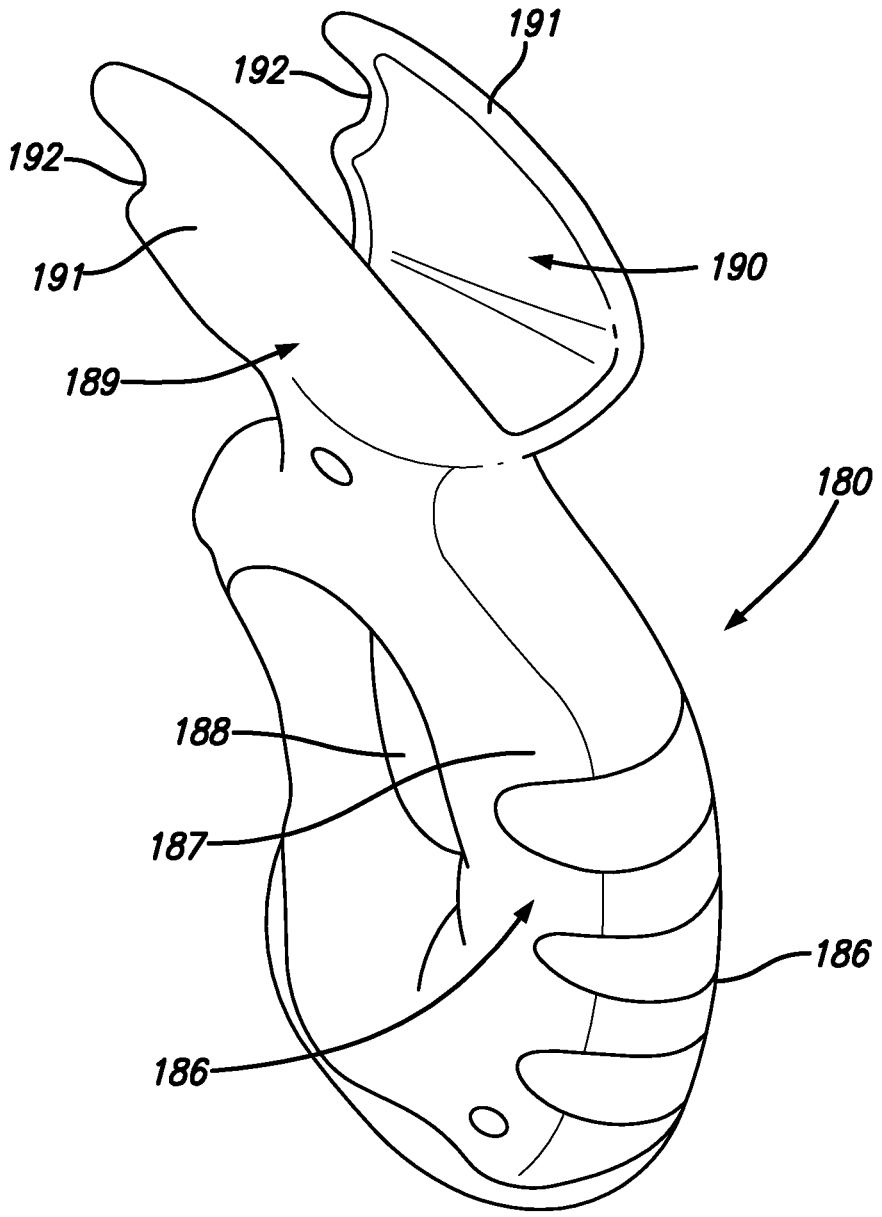
FIGS. 9A and 9B are perspective views of an example launcher and a launcher loaded with a launchable projectile, respectively, as disclosed herein.
Figure 9B:
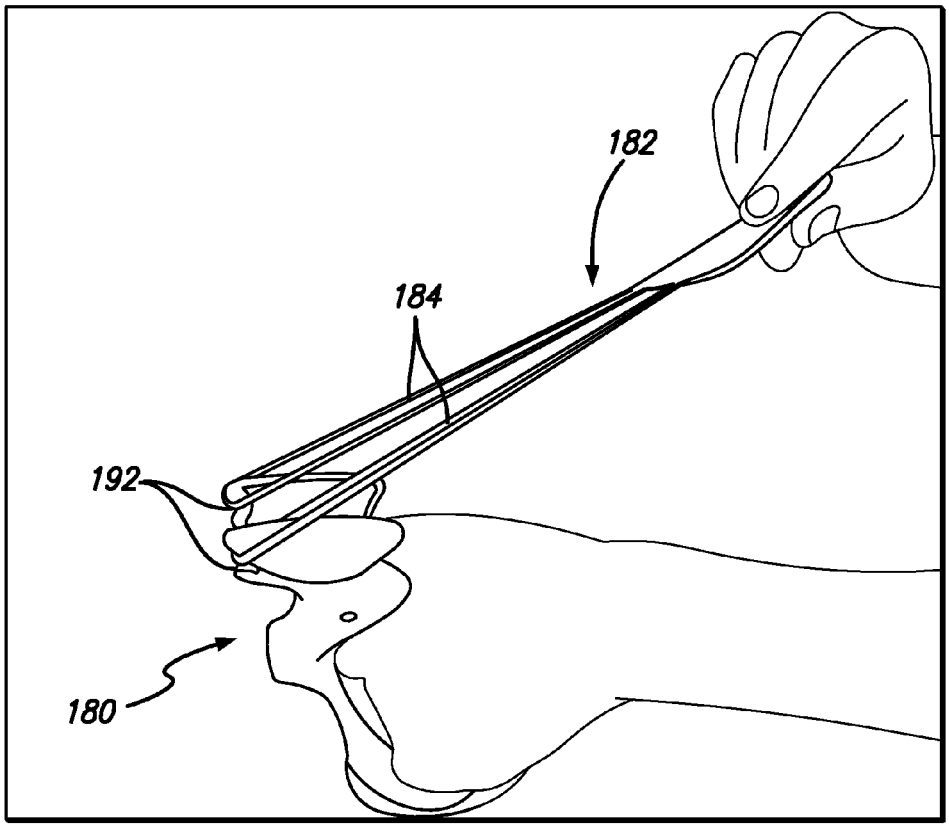

FIGS. 9A and 9B illustrate a launcher 180 with and without a projectile. Referring to FIG. 8A, the launcher is generally configured to facilitate launching a projectile 182 comprising a pair of projecting members 184. Specifically, the launcher 180 comprises a body 186 having a handle member 187 that is configured to fit firmly within a user's hand when being grasped between the user's palm and fingers. The handle member includes an opening 188 configured to accommodate placement of one or more of a user's index, middle, ring and little finger therein. The body 186 includes a launch member 189 that extends upwardly a distance from the handle member 187. The launch member 189 comprises a central valley 190 that extends horizontally relative to the handle member, and that includes a pair of upwardly directed arms 191 each having recessed sections 192 positioned along a frontward facing surfaces 194 of the arms 191. The valley and arms are configured, along with the recessed sections to facilitate launching of a projectile therethrough. As illustrated in FIG. 9B, the projectile is energized and launched by the user holding the launcher 180, placing the projectile projecting member openings within respective arm recessed sections 192 and then pulling the projectile away from the launcher, thereby stretching the projecting members and energizing the projectile for launch. The projectile is launched and released from the launcher by the user releasing the projectile body.

Figure 10:
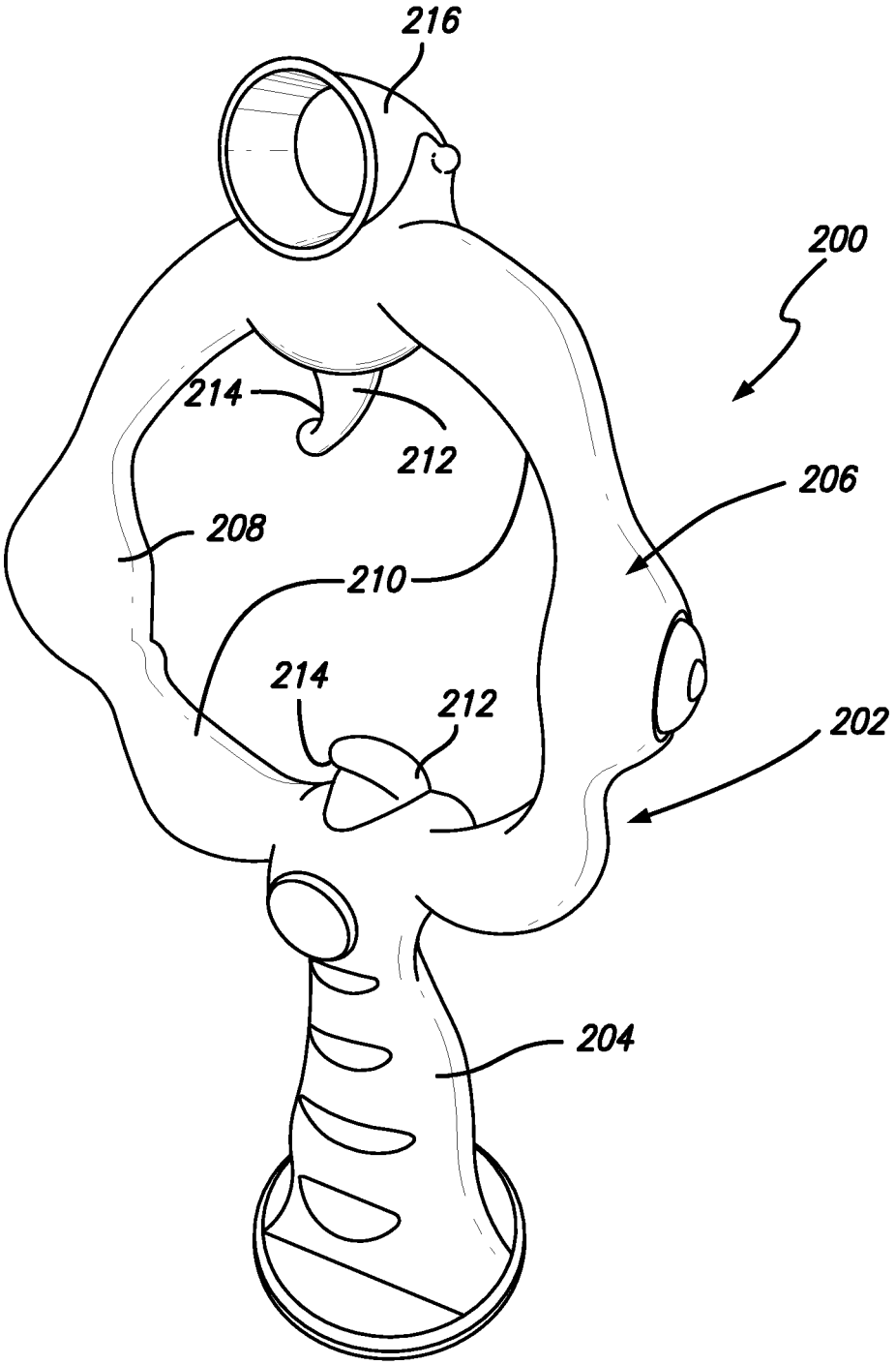
FIG. 10 is a perspective view of a launcher as disclosed herein.

FIG. 10 illustrates a launcher 200 that is generally configured to facilitate launching a projectile comprising a pair of projecting members. Specifically, the launcher 200 comprises a body 202 having a handle member 204 that is configured to fit firmly within a user's hand when being grasped between the user's palm and fingers. The body 202 includes a launch member 206 that is positioned on top of the handle member and that comprises frame 208 that defines an annular launch opening 210 therethrough. The annular launch opening 210 is configured to facilitate passage of a projectile therethrough during a launch operation. The frame includes a pair of surface elements 212 that are positioned and configured to engage the openings within respective projecting members of a projectile. In an example, the surface elements are provided in the form of hooks that are extend inwardly into the annular launch opening 210 and that are diametrically opposed to one another. In the illustrated example, the hooks are oriented vertically relative to one another along the frame. It is to be understood that the hooks can be positioned differently within the frame, and that such alternative positioning is within the scope of the launcher as disclosed herein. In an example, the hooks are shaped to provide a recessed section 214 to accommodate the projectile projecting member openings therein. In the example illustrated, the hooks are configured with the recessed sections in a forward facing orientation, i.e., a direction facing in the direction of projectile flight once launched.

The launcher can include a light element 216 that is disposed on the frame 208, e.g., that is positioned on top of the frame 208. The light element can in the form of an LED or other light element, and is provided to project a forward directed light beam as desired distance useful as an aiming aid to the user. In an example, the launcher is configured with a switch that activates the light element 216, e.g., when a projectile is loaded therein for launching. In an example, the switch is actuated by one of the hooks, wherein one of the hooks is movable to activate the light element when a projectile is loaded within the launcher and to deactivate the light element once the projectile is launched. A projectile as disclosed herein is energized and launched by the user holding the launcher 200, placing the projectile projecting member openings within respective hook recessed sections 214, and then pulling the projectile away from the launcher, thereby stretching the projecting members and energizing the projectile for launch. The user can use the light element to help aiming the projectile at an intended target, and the projectile is launched and released from the launcher by the user releasing the projectile body.

While particular examples of projectiles and launchers for the same as disclosed herein have been described, it is to be understood that these examples were provided for the purpose of reference and that other variations of projectiles and launchers for the same not described but including the same general construction features and elements do not depart from the spirit and scope of projectiles and launchers as disclosed herein, and are thus intended to be included within the scope of the projectiles and launchers as described herein in description, as illustrated in the accompanying drawings, and as set forth in the accompanying claims.

What is claimed is:

1. A projectile for launching through the air comprising:

a body made from an elastomeric material; and a pair of projecting members formed from the elastomeric material each extending outwardly a distance from the body and integral therewith forming a one-piece molded construction, wherein the projecting members have a thickness that is less than that of the body and each have an opening therethrough for engaging a launching device, and wherein the projecting members stretch relative to the body to energize the projectile for launch by release of the body, and wherein the body is configured having a thickness measured perpendicular to the projecting members that is greater than that of the projecting members in a non-stretched state.

2. The projectile as recited in claim 1 wherein the body comprises a hollow construction.

3. The projectile as recited in claim 1 wherein the body comprises a solid construction.

4. The projectile as recited in claim 3 wherein the body comprises an opening extending therethrough.

5. The projectile as recited in claim 1 wherein the body includes one or more surface features extending therefrom that are separate from the projections.

6. The projectile as recited in claim 1 wherein the opening is elongate when the projections are in a non-stretched state and extends a distance along the projecting members.

7. The projectile as recited in claim 1 wherein the opening is positioned adjacent a distal end of the respective projection to engage elements of a launch device.

8. The projectile as recited in claim 1 wherein the body is in the shape of a sphere and is solid or hollow.

9. A launch device for launching the projectile as recited in claim 1, wherein the projecting members openings engage extending features of the launch device, and wherein the launching device comprises a handle.

10. A system for launching a projectile comprising;

a projectile having a body comprising an elastomeric material and energizable projecting members formed from the elastomeric material and integral with the body forming a one-piece construction, the projecting members extending outwardly from the body and each including openings disposed therethrough, wherein the body has a thickness as measured perpendicular to the projecting members that is greater than a thickness of the projecting members when the projecting members are in a non-stretched state;

a launch device comprising outwardly extending elements to engage the projecting member openings to energize the projectile for launch by pulling the body away from the outwardly extending elements.

11. The system as recited in claim 10 wherein each opening is positioned adjacent a peripheral end of a respective projecting member.

12. The system as recited in claim 10 wherein each opening has an elongate configuration extending along a length of a respective projecting member when the respective projecting member is in a non-stretched state.

13. The system as recited in claim 10 wherein the launch device has a handle and whererin the pair of outwardly extending elements are integral with the handle.

14. The system as recited in claim 10 wherein the projecting members are oriented less than about 180 degrees apart from one another relative to the body, and wherein the body has a spherical shape.

15. A method for launching a projectile through the air comprising the steps of:

engaging a projecting member extending from a projectile with an element of a launch device, wherein the projecting member includes an opening disposed therethrough for engaging with the element and extends from a projectile body and both the body and the projecting member comprises an elastomeric material, wherein the body and projecting member are an integral one-piece construction, and wherein the body has a thickness measured perpendicular to the projecting member that is greater than the projecting member when in a non-stretched state;

retracting the projectile body a distance from the launch device while the projecting member is engaged with the launch device to energize the projectile for launch; and releasing the projectile body causing the projectile to be launched away from the launching device and into the air.

16. The method as recited in claim 15 wherein the projectile body is configured having a spherical shape.

17. The method as recited in claim 15 wherein the projectile body comprises one or more surface features extending outwardly therefrom and separate from the projecting member.

18. The method as recited in claim 15 wherein the projectile body comprises a pair of projecting members that are each engaged with a respective launch device element.

* * * * *